US005669694A

United States Patent [19]

Morton, Sr.

[11] Patent Number: 5,669,694

[45] Date of Patent: Sep. 23, 1997

[54] SELF ACTIVATED KEYBOARD ILLUMINATOR AND ACCESSORY

[76] Inventor: Ronald N. Morton, Sr., 12740 Jimeno Ave., Granada Hills, Calif. 91344

[21] Appl. No.: 226,021

[22] Filed: Apr. 11, 1994

[51] Int. Cl.[6] ..... F21V 13/00

[52] U.S. Cl. ..... 362/33; 362/234; 362/253; 362/396; 362/427; 362/802

[58] Field of Search ..... 400/716; 362/85, 362/89, 234, 220, 225, 253, 427, 33, 396, 802

[56] References Cited

U.S. PATENT DOCUMENTS

| | | | |
|---|---|---|---|
| 2,800,573 | 7/1957 | Hudson | 362/89 |
| 3,548,184 | 12/1970 | Fletcher | 400/716 X |
| 5,369,560 | 11/1994 | Friedman | 362/396 |

*Primary Examiner*—Stephen F. Husar

[57] ABSTRACT

Two embodiments for an illumination system are described as a lighting system for computer keyboards and copy text holders and any related printed materials. The first embodiment, a novel keyboard lighting fixture, which is the principal device and includes a base for securing to the underside of keyboards or directly onto a work station, fixed or movable, thereby stabilizing the light fixture to allow pivoting of the housing. The pivoting of the housing to a desired operational position energizes the system which is powered by a plug-in transformer. The second embodiment, the copy text illuminator, is half the size of the keyboard light and is powered by a cord that connects the two light fixtures, making it an auxiliary fixture, to the keyboard light. The cord allows total flexibility and the employment of Velcro pads on each end together with a Velcro strap, enables placement of this light fixture on horizontal or vertical work surfaces. The auxiliary light fixture is powered via the keyboard light or via a stand-alone transformer. The keyboard light and the auxiliary fixture are mounted so that light emitted is directed only onto the keyboard or the copy text holder.

3 Claims, 5 Drawing Sheets

SELF ACTIVATED KEYBOARD ILLUMINATOR AND ACCESSORY

FIELD OF THE INVENTION

The present invention is related to illumination devices and or accessories which may secure to a computer keyboard, drawer or the work space beneath a keyboard and is the host for an accessory or slave device unsecured for viewing objects on a vertical or horizontal plane. More specifically, this invention relates to an AC powered, low-voltage plug in transformer, which is the power source for the host illuminator and an accessory light which is energized by lifting the light bar into the operating position and the slave device that is powered by plugging a cord into the host, thus allowing a comfortable light level to view the keys and number pad of a keyboard. The total adjustablity of the host device and the slave device provide reduced glare and allows the viewing of objects such as keyboards, paper, drawings or documents in a darkened environment.

BACKGROUND OF THE INVENTION

The Prior Art for lighting keyboards in a darkened environments such as computer training schools, commercial designers using Computer Aided Design (C.A.D.) and home users, have been attempted by the use of a point source illuminator, mounted adjacent to the keyboard. The Prior Art created three additional problems for their users. Number one, they occupy work surface space; number two, they needed constant relocation due to limited work surfaces making them a obstacle; number three, provided uneven illumination too bright to be practical.

Other considerations for over lighting are; one, eye fatigue of the eyes due to strain to over come reflective glare; two, reduced productivity due to attempting to see in over lighted conditions and activating the wrong control keys; three, excessive power usage; and fourth, is the need to replace the light bulbs.

Other Prior Art such as U.S. Pat. No. 4,626,965, to Gopta, 362–249, restricts users application to a custom cabinet and limited hardware considerations with little or no adjustability to redirect illumination that would create glare.

With U.S. Pat. No. 5,122,941, to Gross, 362–276, the illumination device is a single point source and limited to mounting on clipboards, and the luminaries do not allow a clear field of vision between the user and a instructor.

Therefore the need for a low level linear light source that is compact, reduces glare and is easy to use and is needed for people who operate keyboards or read reference materials in a darkened environment.

SUMMARY OF THE INVENTION

The present invention is an apparatus for illuminating computer keyboards and reference materials. A hinged support bracket which is secured by double face tape or screws, in a manner that cradles the keyboard to allow the pivoting of the host illumination device from an off position, which is down, wrapped around the keyboard, to an on position which is any position above a 40 degree angle. When energized, by the activation of the rotary switch the host illumination device will provide a low level linear light for a keyboard and a power supply for the slave light. Said rotary switch that is built into the left side arm where the power cord comes from a 12 volt AC plug in transformer, is constructed of a two part printed circuit board material with an etched path for completing the electric circuit. Once the user has lifted the host illumination device into the position that is most comfortable for viewing the host illuminator can be released and it will stay in that position by means of friction created by wave washers that maintain pressure sufficient to stabilize the light bar during the time of use. On the left end on the side at the top edge of said host illumination device is a female receptacle that allows the use of the slave illumination device. Said slave is the same type of light source as the host but one half the size, and non-hinged with a clear triangle plastic base that serves as a ballast or weight on the bottom, which can be secured on a vertical surface with velcro straps or placed on a horizontal surface and connected to the power source by a wire with a male plug, This present host illumination device provides needed illumination for keyboards in a darkened environment that employes a string of 10 bulbs for the host unit and 5 bulbs for the slave unit which are low voltage miniature light bulbs wired in parallel that are rated at 40,000 hours of use. Being strung together by means of a printed circuit board and wires in the host illumination device, thereby providing the results of a linear light source thus overcoming the problem of Prior Art being a point source. The light level is low and warm in color. The slave illumination device, when plugged in, will provide a mobile light source in conjunction with the host, for illumination on clip board stands, large drawings and other reference materials.

BRIEF DESCRIPTION OF THE DRAWING(S)

DETAILED DESCRIPTION OF THE PREFERRED EMBODIMENT(S)

Figure 1:
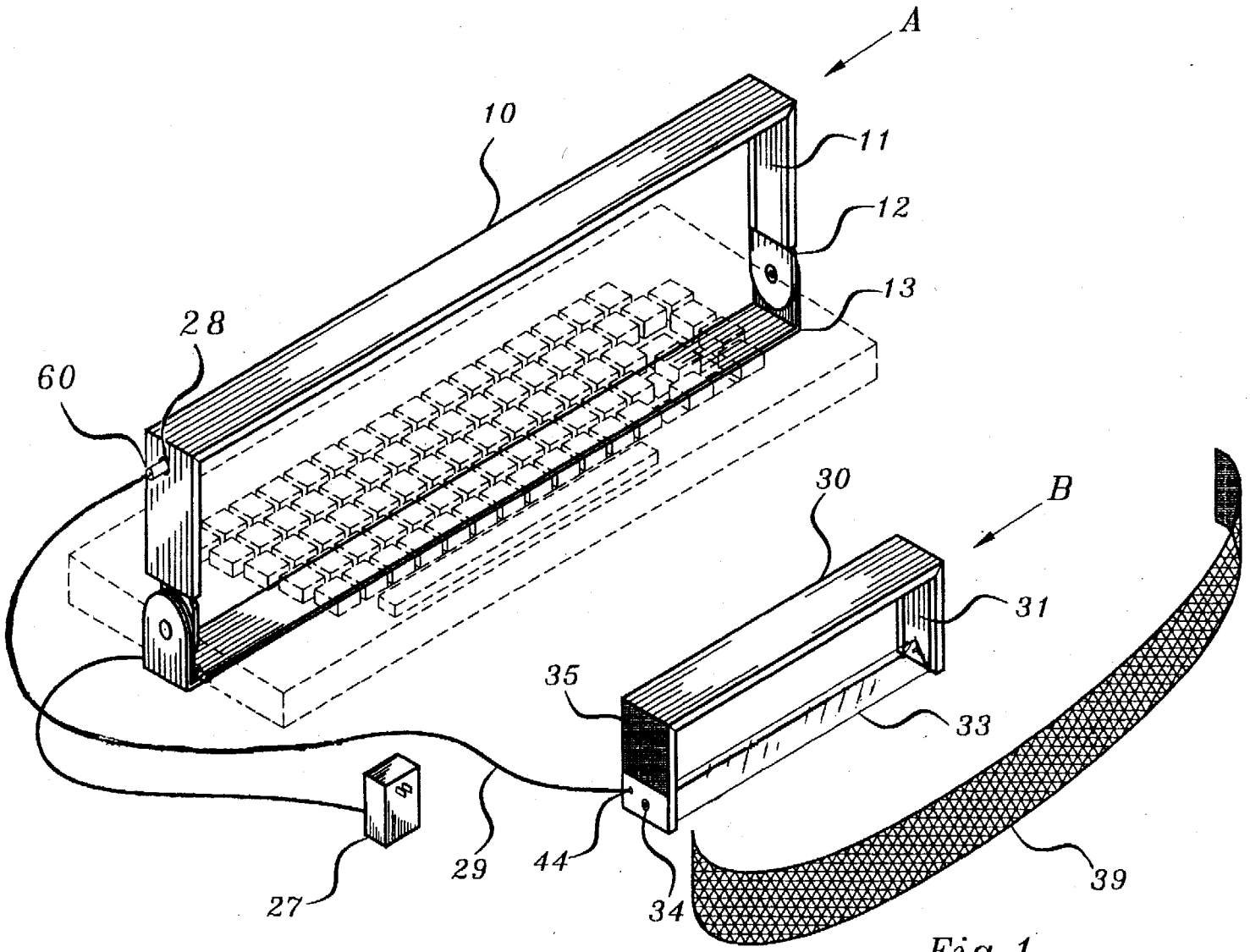
FIG. 1 is a perspective view of the host keyboard illuminator (A) and the slave or accessory illuminator (B) in a accordance with two embodiments of the present invention.

Referring now to the drawings and more particularly to FIG. 1, the first embodiment A of the invention is a self activated keyboard illuminator shown together with the slave accessory embodiment B. The power for the host illuminator is provided by a plug in transformer 27 that reduces the voltage from 120 to 12 volts. Embodiment A has at the top left hand side a female receptacle 28 that in turn provides the power for the slave accessory by means of a male plug cord 29 from the host illuminator.

Figure 4:
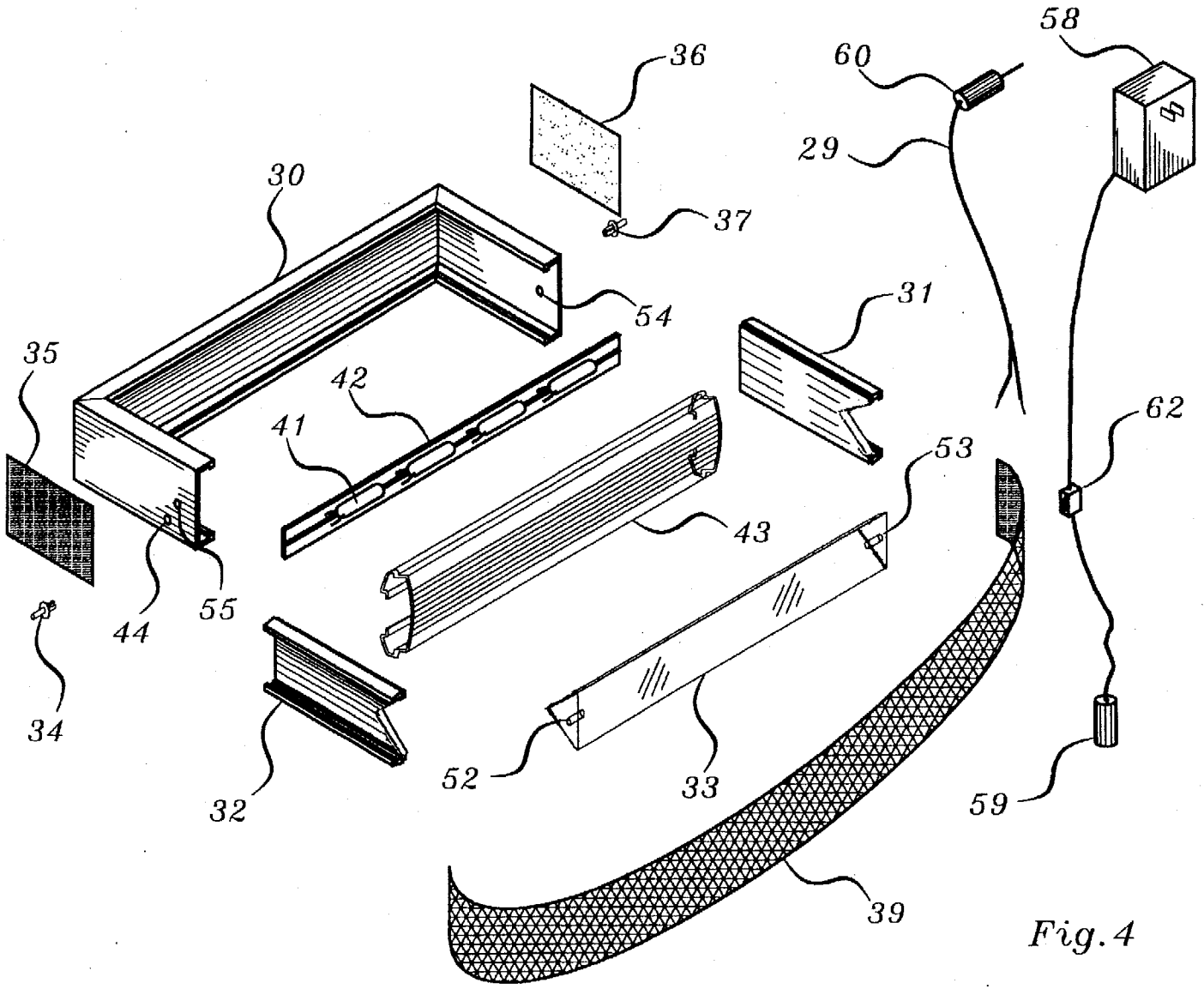
FIG. 4 is a exploded view of the embodiment of the slave or accessory illuminator.

Referring now to the drawing in FIG. 1, embodiment B of the invention, the slave or accessory illuminator, is shown in a perspective view, is powered by the same transformer 27 that powers the host illuminator A, and is connected through a female receptacle 28 that provides power to the slave accessory through a male plug cord 29 with a single pair of wires being light weight and highly flexible. This embodiment B can also be operated alone with it's own transformer 27 (FIG. 4). The embodiments shown A and B are illuminators in the category of incandescent low-voltage lighting.

Figure 2:
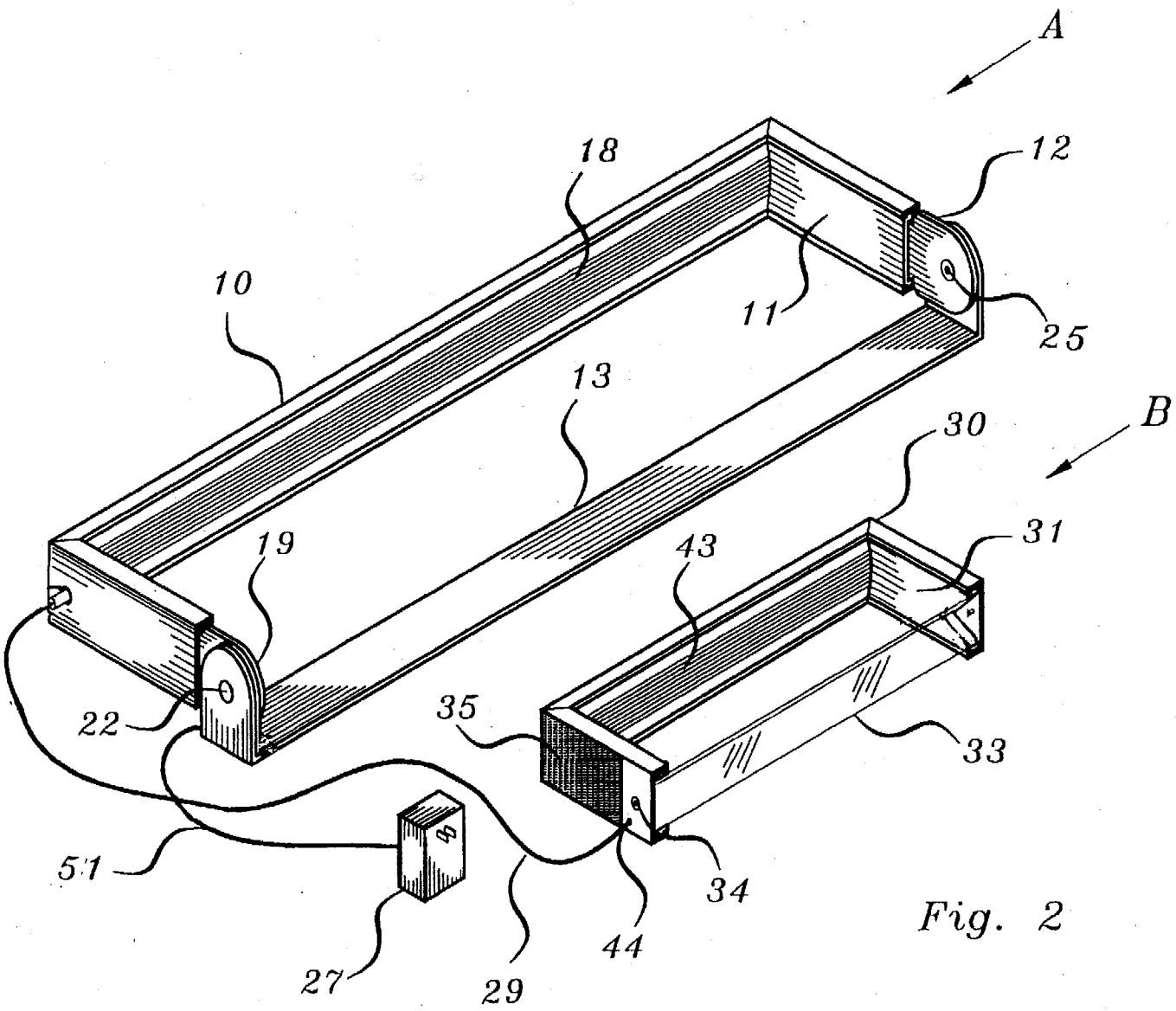
FIG. 2 is a perspective view of the same two embodiments with the host illuminator showing the extreme point of rotation thus revealing the lens.

Referring now to the drawing in FIG. 2 also a perspective view embodiment A showing "the lightbar" rotated to 0 degrees thereby demonstrating 0–180 degrees pivoting capability and exposing the lens 18 that is held in place by the outer body referred to as "the lightbar" 10 and is made of aluminum with a powder coated paint finish, is channeled to receive the lens 18 and both snap covers 11 and (14 shown in FIG. 3) made of plastic, which in turn have inserted into them the hinge arms 12 made of steel and also powder coated paint, on the right side and on the left side the hinge arm 19 which is part of the self activated switch and is made of printed circuit board fiberglass material. Both hinge arms 19 and 12 are inserted into their perspective snap covers 11 and (14 shown in FIG. 3) thereby being secured to the base or stabilizer 13 made of steel and also powder coated paint, by means of steel rivets flared on the end opposite the head 22 and (25 shown in FIG. 3) that are expanded through the two before mentioned hinge arm parts on both sides with spring washers 24 and (25 shown in FIG. 3) thereby securing the arm assemblies together thus the providing pivot points for the light bar assembly. The stabilizer 13 is secured beneath the keyboard either by double face tape or screws. The embodiment B of FIG. 2 is a perspective showing the assembly laid on it's back to reveal the lens 43 that is held in place by the outer shell 30 is the same basic construction as the host illuminator made of aluminum and powder coated paint finish. The snap covers 31 and (32 shown in FIG. 4) made of plastic, that provides a grove to receive the guide rule 33 which is transparent plastic, which also serves as a ballast and thereby being secured on both ends by means of a expanding rivets 34 and (37 shown in FIG. 4) made of plastic thus stabilizing the unit for horizontal use. The arms of the slave accessory B are velcro covered 33 and (36 shown in FIG. 4) will allow a strap (39 shown in FIG. 4) to secure the illuminator to vertical surfaces.

Figure 3:
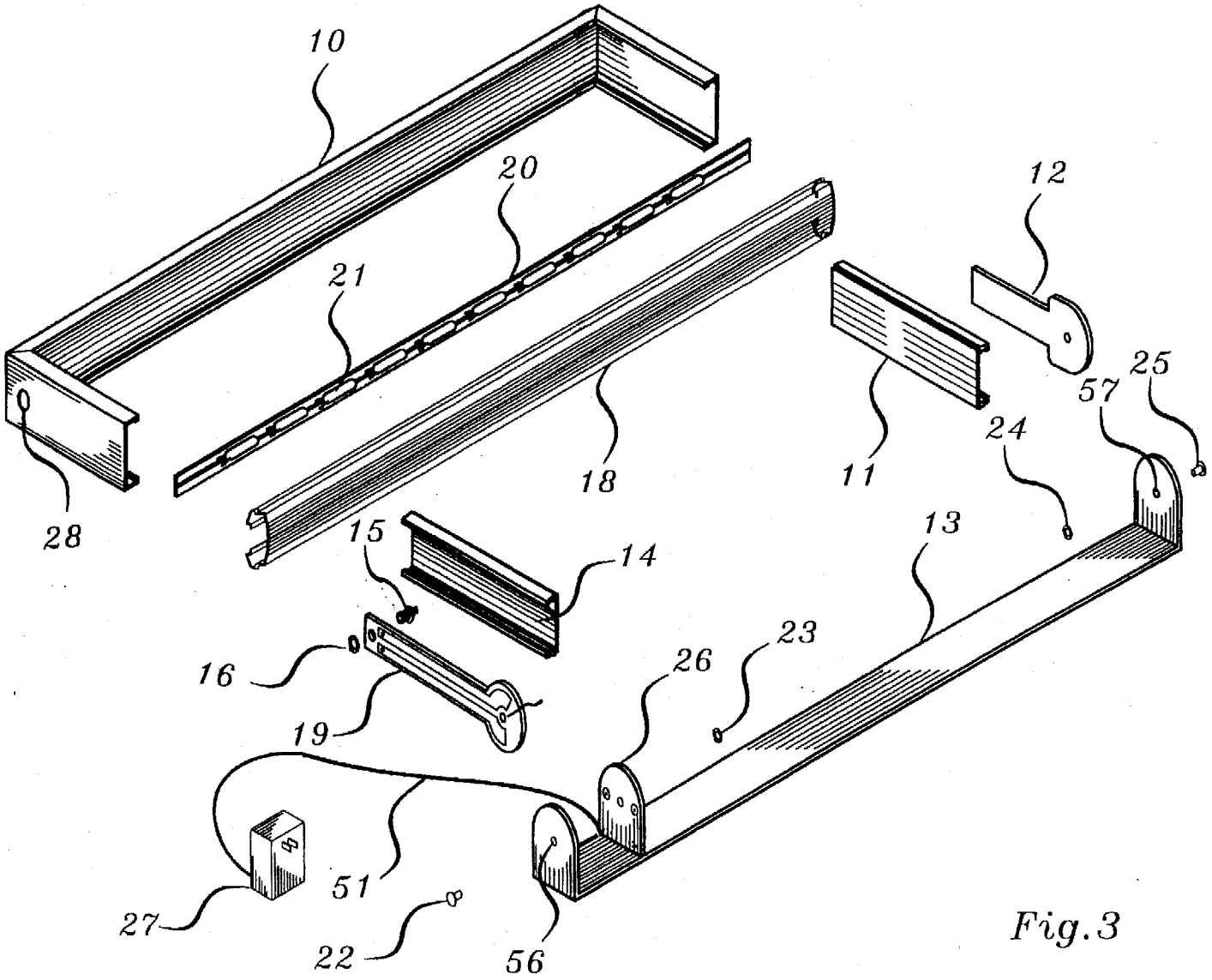
FIG. 3 is a exploded view of the embodiment of the host illuminator.

Referring now to FIG. 3 an exploded view in a perspective of the host illuminator embodiment A revealing the illumination source 20 a printed circuit board that is called "the bulb strip" 20 with ten miniature low voltage light bulbs 21 spaced one and three quarter inch on center and has two wires 17 with soldered connections to the printed circuit board hinge arm 19. The wires 17 pass through the female receptacle 15 and receive solder at each contact point and are terminated at holes 47 in the hinge arm 19. The receptacle 15 is then installed through the hinge arm 19 and a lock nut 16 secures the two items together. The lens 18 holds the bulb strip 20 in position and after snapping together along the lingerer part of 10 "the lightbar" is thereby reinforced by snap arm covers 14 and 11 with the hinge arms 19 and 12 inserted therein. The printed circuit board hinge arm 19 is part of the self activating switch and has a hole marked 46 that mates with switch contacts 26 and is held together by means of a steel rivet 22 inserted through the exterior of the stabilizer 13 at the hole marked 56 passing through it to the printed circuit board arm hinge 19 then through the switch contact 26, finally receiving a spring washer 23 then the rivet is then flared so as to created pressure on the assembly that will allow pivoting.

Referring now to FIG. 4 an exploded view in a perspective, of the embodiment B, of the invention referred to as slave accessory. Revealing the illumination source 42 a printed circuit board "the bulb strip" with five miniature low voltage light bulbs 41 spaced one and three quarter inches on center and secured in the same fashion as the host illuminator embodiment A with the same lens 43 except the lens is half the length as lens 18. The snap covers 31 and 32 made of plastic, have V groves to receive the guide rule 33 which is transparent plastic, that also serves as a ballast to help upright the unit when free standing and thereby being secured on both ends by means of a expanding rivets 34 and 37 are made of plastic that are inserted through arms on 30 at the holes marked 54 and 55 in the triangle shaped base 33 which is provided with two holes 52 and 53 thus stabilizing the unit for horizontal use. The arms of the slave accessory B are velcro covered 33 and 36 will allow a strap 39 to secure the illuminator to vertical surfaces. The power supply for the embodiment, as a slave illuminator, is derived from the host embodiment A FIG. 1 via plug cord 29 being a single pair conductor, which passes through the arm on 30 at a hole 44 and is soldered to the bulb strip 42. The power supply for the "STAND ALONE" accessory is the same step down transformer 27, converting AC line voltage to low-voltage, then to control the on off operation of the "STAND ALONE" unit, an in-line thumb switch 60 on the power cord 51 is employed. The "STAND ALONE" accessory which will also have, in the cover 30 a hole 58 in arm to secure the female terminal 60 with a lock nut 59 on the outside to provide stability. The power will be conducted through a single pair of wires 61 that connects the end of the bulb strip 42 with solder connections, thus allowing up to two slave accessory units to operate from the "STAND ALONE" unit power which employes the same kind of transformer 27 (all other functions of the illuminator are the same).

Figure 5:
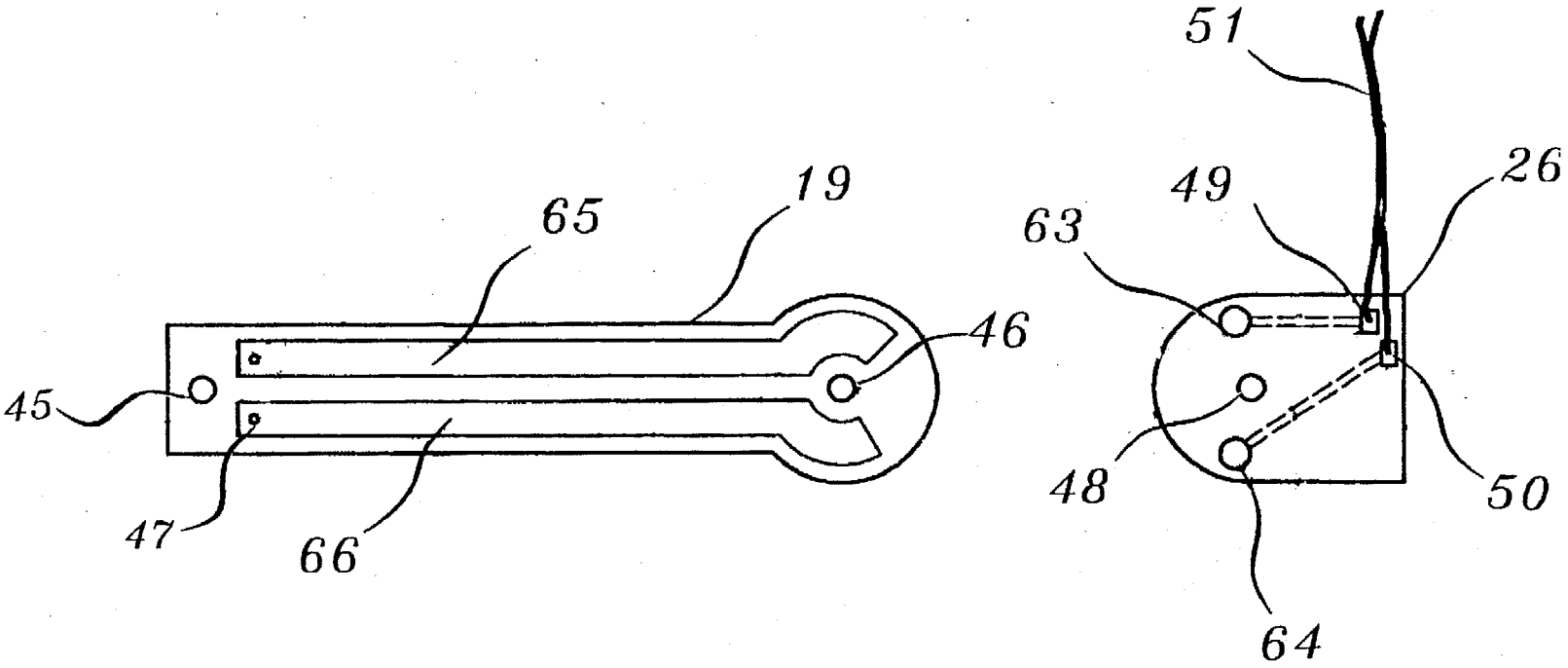
FIG. 5 is the front views of the self activated switch parts.

Referring now to FIG. 5 front views of the parts for the printed circuit switch, consisting of the hinge arm 19 and the switch contacts 26, showing in the arm details of hole 45 for securing the female receptacle 15 shown on FIG. 3, the termination holes 47 for the power transfer wire 17, the pivot hole 46 that aligns the arm 19 with the switch contacts on 26 which shows the power path coming from the power cord 51 to solder contact points 49 and 50, thereby transmitting power to the arm though the contact pads 63 and 64 that will make contact to the conductor path on the hinge arm 19 marked 65 and 66 allowing the power to flow through the wires 17 that are terminated at holes marked 47 with a solder connection. When hole 46 on hinge arm 19 and hole 48 on switch contacts 26 are aligned and held in position by the steel rivet 22, allowing the rotation of the hinge arm 19 against the switch contacts 26, thus making and braking the circuit, turning on and of the illuminators.

The foregoing specification sets forth the invention of a computer illumination accessory in its preferred, embodiments but the structures shown are capable of modification within a range of equivalents without departing from the invention which is to be understood as broadly novel and unique and is commensurate with the appended claims.

Having fully disclosed how to use and how to make the invention, the scope of my claims may now be understood to be as follows:

I claim:

1. A lighting system for a computer keyboard with an accessory light comprising a lamp housing having an elongated light source which directs illumination downwardly onto a generally horizontal computer keyboard, said lamp housing being supported at both ends by arms which space the lamp housing above the computer keyboard, said arms being pivotally supported by a base upon which the computer keyboard is situated, the pivotal support between the arms and the base further having a position responsive electrical switch which activates the elongated light source when the lamp housing is pivoted into an operable position over the computer keyboard, the position responsive electrical switch is connected to an electrical power supply via an electrical transformer, said lamp housing further having a light diffusing means which directs light only on said computer keyboard while avoiding illumination on a computer monitor.

2. A computer lighting system as set forth in claim 1 wherein the accessory lighting comprises an illuminated copy text holder having a smaller lamp housing than that of the lamp housing associated with the computer keyboard, the smaller lamp housing having a light source and being supported above and generally horizontal by support arms to a weighted base which facilitates placement of the illuminated copy text holder on a horizontal surface as well as a strap attachment fastened to the support arms to secure the illuminated copy text holder to any vertical copy stand and a power cord which connects the illuminated copy text holder to the power supply of the computer keyboard lighting system.

3. The lighting system for a computer keyboard of claim 1 wherein said electrical switch comprises two components, a stationary component providing a power connection from said electrical power supply and an adjustable, pivoting component that serves as a power path through said arm to said lamp housing.

* * * * *